United States Patent [19]

Slutzky

[11] 4,395,680

[45] Jul. 26, 1983

[54] AUTOMOBILE TIMING LIGHT

[75] Inventor: Azriel Slutzky, San Jose, Calif.

[73] Assignee: Sun Electric Corporation, Crystal Lake, Ill.

[21] Appl. No.: 220,819

[22] Filed: Dec. 29, 1980

[51] Int. Cl.[3] ..... F02P 17/00

[52] U.S. Cl. ..... 324/392; 315/241 S

[58] Field of Search ..... 324/391, 392; 315/241 S

[56] References Cited

U.S. PATENT DOCUMENTS

| | | | |
|---|---|---|---|
| 3,573,609 | 4/1971 | Vaher | 324/391 |
| 3,727,124 | 4/1973 | Kahen | 324/392 |
| 3,774,073 | 11/1973 | Switsen | 315/241 S X |
| 3,946,271 | 3/1976 | Stepp et al. | 315/241 S X |
| 3,953,763 | 4/1976 | Herrick | 315/241 S X |

FOREIGN PATENT DOCUMENTS

| | | | |
|---|---|---|---|
| 831671 | 3/1960 | United Kingdom | 324/391 |

*Primary Examiner*—Stanley T. Krawczewicz
*Attorney, Agent, or Firm*—Allegretti, Newitt, Witcoff & McAndrews, Ltd.

[57] ABSTRACT

An automobile timing light for use with an internal combustion engine. The timing light includes a skip circuitry for regulating the time between flashes of a flash circuitry for permitting a sufficient charge to develop across a flash powering capacitor between successive flashes. The timing light thus provides a uniformly bright light flash irrespective of engine r.p.m.

5 Claims, 2 Drawing Figures

AUTOMOBILE TIMING LIGHT

BACKGROUND OF THE INVENTION

The present invention relates generally to automotive timing lights and more particularly to a timing light having stable brightness at high engine r.p.m.'s.

Many automotive timing lights presently available include a circuit containing a flash capacitor and a flash tube, connected for generating repetitive flashes of light in coordination with the firing of the number one cylinder of the engine. During operation of the timing light, the flash capacitor is charged to a particular voltage, often in a range between 500 and 700 volts, and then is discharged into the flash tube for generating the flash of light.

The charging of the flash capacitor takes a discrete period of time depending on the value of the flash capacitor and other charging circuit components which are involved. If the engine is running slowly, there is sufficient time after the flash capacitor has been discharged to re-charge the same to a full voltage prior to the next flash. In checking the vacuum and/or mechanical advance of the timing system of the engine, it becomes necessary to run the engine at high speeds. If the engine is running rapidly, however, insufficient time between successive firings of the number one cylinder will cause the flash capacitor not to fully charge. When this occurs, a smaller than normal amount of energy is stored in the flash capacitor and discharged through the flash tube. This will result in the generation of a weak flash of light or no flash at all.

Weak light flashes are undesirable since they make it difficult for an operator of the timing light to notice when the light flash occurs, particularly where the engine is being timed in a well-lit area.

If the flash capacitor has insufficient time to fully charge, the capacitor's voltage may prove insufficient to ionize the gas within the flash tube and no light flash will be emitted. This causes erratic flashing and subjects the timing light to criticism by consumers that the light is malfunctioning.

SUMMARY OF THE INVENTION

It is therefore an object of the present invention to provide an improved timing light for use with an automobile engine.

It is yet another object of the present invention to provide a timing light that systematically generates light flashes no faster than a predetermined rate.

It is a further object of the present invention to provide a timing light that gives bright light flashes, even when the associated automobile engine being timed is operated at a high speed.

It is yet another object of the present invention to provide a timing light utilizing inexpensive circuitry components.

These and other objects of the invention are achieved in a timing light having a flash circuitry for providing a flash of light in conjunction with the firing of an engine cylinder which is monitored by a coupler element. The coupler element provides an input signal to a trigger circuit which responsively activates the flash circuitry. A skip circuitry disables the trigger circuit for a predetermined period of time after an activation of the flash circuitry in order to permit a flash capacitor within the flash circuitry to charge to a predetermined level.

If the cylinder fires during the predetermined period of time in which the trigger circuit is disabled, no activation of the light flash circuitry occurs and the flash capacitor continues to charge. Because the capacitor is always fully charged before it is allowed to discharge to generate the flash, the brightness of the light is maintained at a stable level.

BRIEF DESCRIPTION OF THE DRAWING

A preferred embodiment of the present invention is described herein with reference to the drawing wherein.

DETAILED DESCRIPTION OF THE PREFERRED EMBODIMENT

Figure 1:
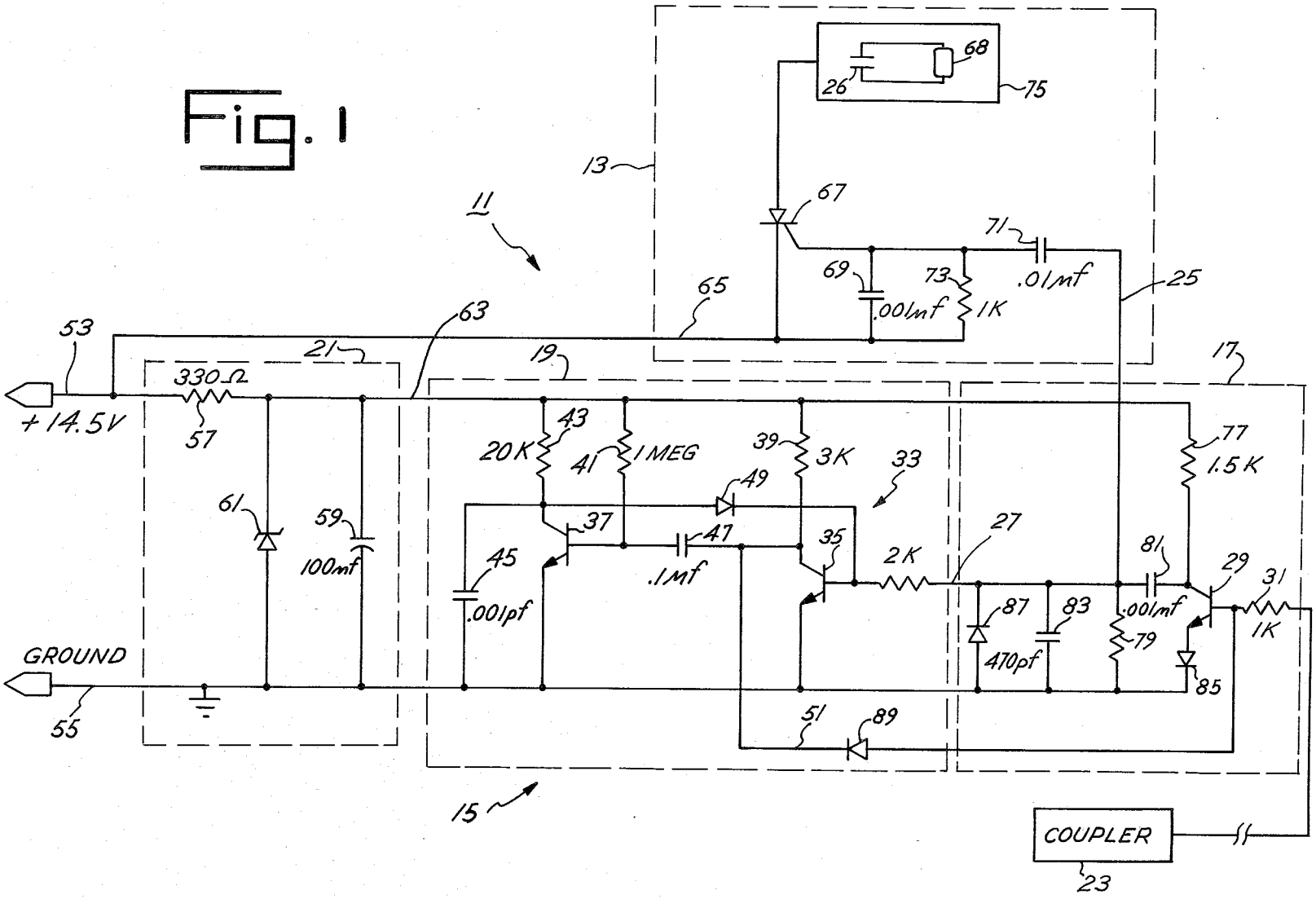
FIG. 1 is a schematic diagram of a preferred embodiment of a timing light of the present invention.

Referring to FIG. 1, a timing light 11 includes a flash circuitry 13 which is repetitively activated in coordination with the firing of an automotive engine (not shown) by a control circuitry 15 which is comprised of a flash trigger circuit 17, a skip circuit 19 and a voltage regulating circuit 21. Control circuitry 15 monitors the repetitive firing of the number one cylinder of the engine via a conventional coupler 23 which is connectable to the engine to be timed.

Coupler 23 generates an output signal representative of the firing of the number one cylinder, for input to trigger circuit 17 for commanding triggering of flash circuitry 13 along a conductor 25. Trigger circuit 17 communicates with skip circuit 19 each time a triggering of the flash circuitry occurs. The skip circuitry serves to disable triggering circuitry 17 for a predetermined period of time after a flash. So long as the trigger circuit remains disabled, the flash circuitry is permitted to charge its conventional flash capacitor 26 to a predetermined value.

Trigger circuit 17 includes a transistor 29 which is connected to coupler 23 via a current protecting resistor 31. With each firing of the number one cylinder of the engine, coupler 23 generates a signal pulse to the base of transistor 29 turning the transistor ON for a short period of time. The turning ON of transistor 29 effectively drives its collector to a voltage close to the ground. A negative-going pulse is thus produced at the collector of transistor 29 which is developed along conductor 25 to flash circuitry 13. Flash circuitry 13 responds to the trailing edge of the negative-going pulse for generating a flash of light.

The negative-going pulse at the collector of transistor 29 is also fed to skip circuit 19 via a conductor 27. Skip circuit 19 includes a monostable multivibrator 33 comprised of a pair of transistors 35, 37 which are connected in circuit with resistors 39, 41, 43, capacitors 45, 47 and a diode 49, as shown in FIG. 1. Transistors 35, 37 operate in a monostable multivibrator mode for generating an astable voltage along a conductor 51 for a predetermined period of time in response to the negative-going pulse from transistor 29.

When the monostable multivibrator is in its astable state, the collector of transistor 35 is driven towards ground, causing a clamping of the base of transistor 29 close to ground and keeping transistor 29 turned OFF. With the base of transistor 29 clamped, transistor 29 will not respond to subsequent pulses from coupler 23. The clamping voltage is automatically removed from conductor 51 as the monostable multivibrator returns to its stable state after a predetermined period of time.

Referring in more detail to FIG. 1, the timing light 11 includes a positive lead 53 which is connectable to the car battery (not shown) and a ground lead 55, for providing power to flash circuitry 13 and voltage regulating circuit 21. Voltage regulating circuit 21 includes a resistor 57, a voltage leveling capacitor 59, and a zener diode 61, connected as shown. Zener diode 61 has a breakdown voltage of approximately 7.5 volts for providing a stabilized voltage level to skip circuit 19 and trigger circuit 17 along a conductor 63.

The car battery voltage is also fed from lead 53 to flash circuitry 13 along a conductor 65. The components of flash circuitry 13 are conventional and several particular components are illustrated in FIG. 1. A silicon controlled rectifier (SCR) 67 serves as the control element for causing flash capacitor 26 to discharge through a flash tube 68 for generating a flash of light. The trailing edge of the negative-going pulse developed along conductor 25 serves to activate SCR 67 into a state of conduction for causing the flash. A capacitor 69 and a resistor 73 filter unwanted noise from conductor 25 and help prevent SCR 67 from firing unless the number one cylinder has fired.

Referring in more detail to trigger circuit 17, transistor 29 is connected in circuit with resistors 77, 79, capacitors 81, 83 and diodes 85, 87, as shown. Upon coupler 23 sensing the firing of the number one cylinder, transistor 29 is turned ON, causing the voltage of its collector to drop from approximately 7.5 volts to about 0.3 volts. The collector remains at 0.3 volts for a small amount of time as determined by the waveform of the output signal developed by coupler 23; after which the collector returns to its 7.5 volt level. This negative-going pulse which is generated at the collector of transistor 29 is differentiated by capacitor 81 and capacitor 71, resulting in the triggering of SCR 67.

Diode 87 prevents the voltage along conductor 27 from dropping substantially below −1 volt. Capacitor 83 filters unwanted noise from conductor 27, and resistor 79 provides a discharge path for capacitors 71, 81. Diode 85 raises, by a fraction of a volt, the amptitude of the voltage necessary to turn transistor 29 ON. Thus, when transistor 35 is ON, the voltage at the collector of transistor 35, along with the voltage across diode 89, will prove insufficient to turn transistor 29 ON. Similarly, diode 85 also prevents noise signals from causing the mis-triggering of transistor 29. Referring in more detail to skip circuit 19, transistor 35 is normally held OFF, maintaining its collector at a voltage of about 7.5 volts. Transistor 37 is normally saturated, i.e.. held ON, with its collector at a voltage of about 0.3 volts. When a pulse is developed along conductor 27, transistor 35 turns ON and transistor 37 turns OFF. Voltage on the collector of transistor 35 drops to about 0.3 volts, developing the same along conductor 51 for clamping the base of transistor 29 close to ground voltage via a diode 89.

Capacitor 47 of the monostable multivibrator 33 begins charging once transistor 35 is turned ON. When the voltage across capacitor 47 reaches a level sufficient to turn on transistor 37, the transistor 35 turns OFF and the disabling signal appearing on conductor 51 is eliminated. As is apparent, resistors 39, 43 bias, respectively, transistors 35, 37, and capacitor 45 filters out unwanted noise.

Figure 2:
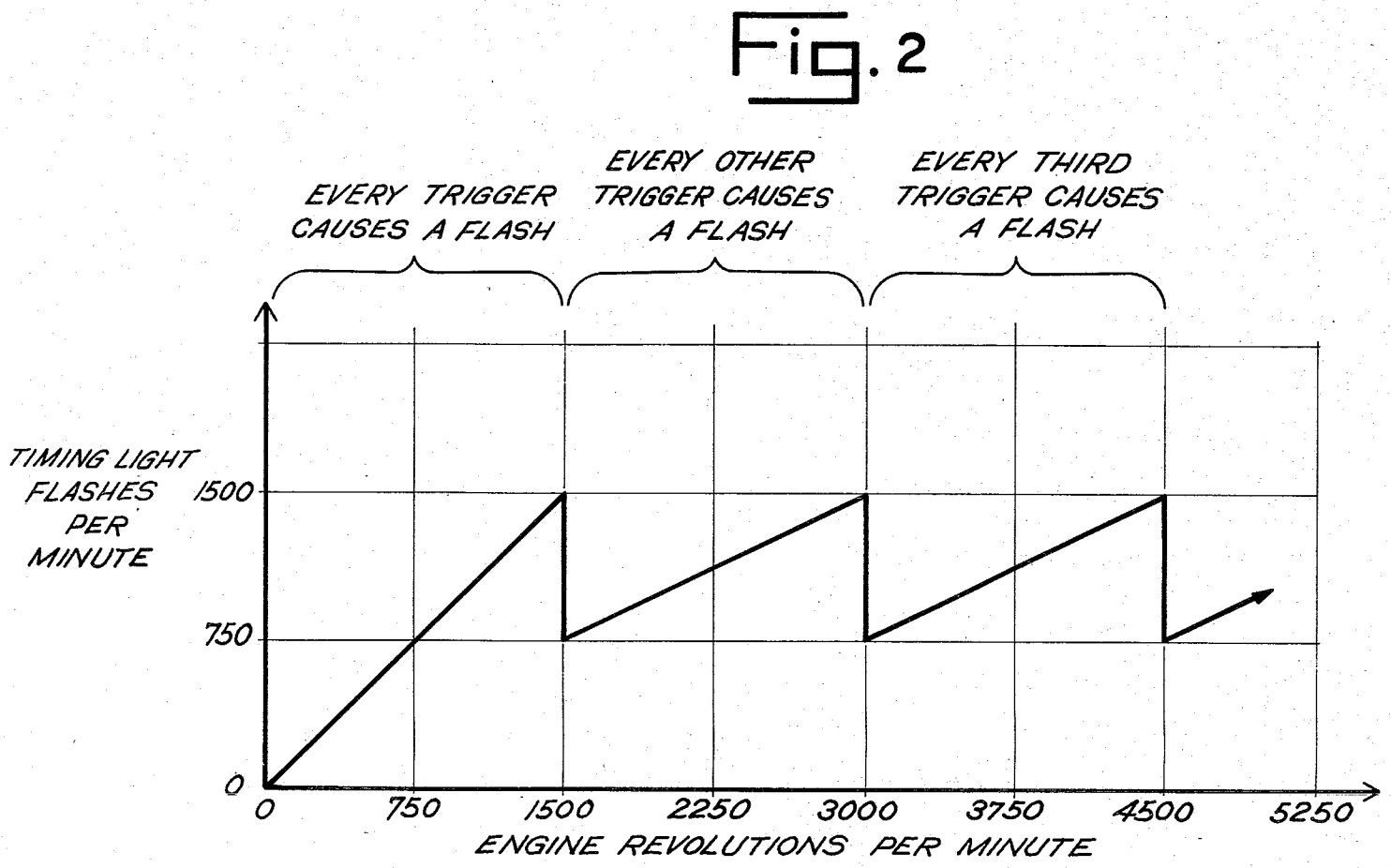
FIG. 2 is a graph showing the flash speed of the preferred embodiment of the timing light of FIG. 1, as a function of engine speed.

Referring to FIG. 2, the results of using the timing light 10 are illustrated in graphical form. The time period of the astable state of monostable multivibrator 33, as determined by resistor 41 and capacitor 47, is such that skip circuit 19 provides a disabling output for about 80 milliseconds. On a four cycle engine, 80 milliseconds between firings of the number one cylinder corresponds to a speed of 1500 r.p.m. Thus, at an engine speed of between 0 and 1500 p.r.m., flash circuitry 13 is activated on every firing of the number one cylinder.

As the engine speed is increased higher than 1500 r.p.m., transistor 29 is disabled during the time of certain firings of the number one cylinder. For example, if the automobile engine is operating at a speed of 2000 r.p.m., the skip circuitry allows a light flash to be admitted only for every other firing of the number one cylinder. As the engine speed increases above 3000 r.p.m., only every third firing of the number one cylinder results in a light flash. Thus, the flash rate never exceeds 1500 flashes per minute.

A single preferred embodiment of the present invention has been described herein. It is to be understood, of course, that changes and modifications may be made in the embodiment without departing from the true scope and spirit of the present invention as defined by the appended claims.

What is claimed is:

1. A timing light for use with an automobile engine having at least one cylinder, the automobile engine intermittently providing a firing voltage to the one cylinder, comprising, in combination:

(a) flash means for providing a flash of light;

(b) couple means for interconnection to the automobile engine and for providing an input signal representative of the firing voltage (c) trigger means for activating said flash means in response to said input signal; and (d) skip circuitry means, responsive to said input signal, for disabling said trigger means from responding to said input signal for a substantially fixed, predetermined period of time after every activation of said flash means by said trigger means, whereby said flash of light has a predetermined brightness.

2. A timing light as claimed in claim 1 wherein said skip circuitry means provides a disabling output signal in response to said input signal, said disabling output signal bearing a signal characteristic for indicating said predetermined period of time.

3. A timing light as claimed in claim 2 wherein said skip circuitry means includes a monostable multivibrator for generating said disabling output signal.

4. A timing light as claimed in claim 2 wherein said trigger means includes controllably conductive means for receiving said input signal and said disabling output signal, said trigger means being disabled whenever said controllably conductive means receives said disabling output signal.

5. A timing light as claimed in claim 4 and further comprising means connectable to a power source; and wherein said controllably conductive means generates a status output signal, said status output signal changing in response to said input signal and said disabling output signal; and wherein said trigger means includes activation means for controllably connecting said power source and said flash means in response to a change in said status output.

* * * * *